US011234901B2

(12) United States Patent
Apell et al.

(10) Patent No.: US 11,234,901 B2
(45) Date of Patent: Feb. 1, 2022

(54) DEVICE FOR SEPARATING MEDICATION PACKAGES AND A MEDICATION DISPENSER

(71) Applicant: Evondos Oy, Salo (FI)

(72) Inventors: Mika Apell, Turku (FI); Jyrki Niinistö, Halikko (FI)

(73) Assignee: Evondos Oy, Salo (FI)

( * ) Notice: Subject to any disclaimer, the term of this patent is extended or adjusted under 35 U.S.C. 154(b) by 0 days.

(21) Appl. No.: 15/647,555

(22) Filed: Jul. 12, 2017

(65) Prior Publication Data

US 2018/0015001 A1 Jan. 18, 2018

(30) Foreign Application Priority Data

Jul. 13, 2016 (EP) ..... 16179224

(51) Int. Cl.
*A61J 7/04* (2006.01)
*B65B 61/06* (2006.01)
(Continued)

(52) U.S. Cl.
CPC ..... *A61J 7/04* (2013.01); *B26D 1/185* (2013.01); *B26D 1/205* (2013.01); *B26D 5/007* (2013.01);
(Continued)

(58) Field of Classification Search
CPC .. A61J 7/04; A61J 7/0076; B26D 1/14; B26D 1/141; B26D 1/185; B26D 1/205;
(Continued)

(56) References Cited

U.S. PATENT DOCUMENTS 4,031,437 A * 6/1977 Dempsey ..... B23Q 15/12 318/39
4,391,168 A * 7/1983 Gerber ..... B26D 1/185 83/13
(Continued)

FOREIGN PATENT DOCUMENTS

DE 2057897 A1 6/1972
EP 1724075 A2 11/2006
(Continued)

OTHER PUBLICATIONS

European Patent Office, Search Report issued in European Patent Application No. 16179224.7 dated Jan. 2, 2017.

*Primary Examiner* — Gene O Crawford
*Assistant Examiner* — Kelvin L Randall, Jr.
(74) *Attorney, Agent, or Firm* — Merchant & Gould P.C.

(57) ABSTRACT

The present invention relates to a device for separating medication packages from a strip of medication packages. The device comprises a cutting base along which the strip of medication packages is to be moved, a circular cutting blade arranged perpendicularly against the cutting base, and an actuator connected to the circular cutting blade and configured to move the circular cutting blade in opposite first and second directions for cutting the strip between two successive medication packages. In the device the actuator is connected to the circular cutting blade with a spring suspension allowing the circular cutting blade to move in opposite third and fourth directions perpendicular to the cutting base.

10 Claims, 2 Drawing Sheets

(51) Int. Cl.

| | |
|---|---|
| ***G07F 11/42*** | (2006.01) |
| ***A61J 7/00*** | (2006.01) |
| ***B65B 61/28*** | (2006.01) |
| ***B26D 7/24*** | (2006.01) |
| ***B26D 7/22*** | (2006.01) |
| ***B26D 5/00*** | (2006.01) |
| ***B26D 1/20*** | (2006.01) |
| ***B26D 1/18*** | (2006.01) |
| *B26D 7/26* | (2006.01) |
| *B26F 1/10* | (2006.01) |
| *B26D 1/00* | (2006.01) |

(52) U.S. Cl.
CPC ..... *B26D 7/22* (2013.01); *B26D 7/24* (2013.01); *B65B 61/06* (2013.01); *G07F 11/42* (2013.01); *A61J 7/0076* (2013.01); *B26D 5/00* (2013.01); *B26D 7/2621* (2013.01); *B26D 2001/002* (2013.01); *B26D 2001/0053* (2013.01); *B26F 1/10* (2013.01); *B65B 61/28* (2013.01)

(58) Field of Classification Search
CPC ..... B26D 1/1575; B26D 5/007; B26D 5/02; B26D 5/08; B65B 57/00; B65B 57/14; B65B 57/16; G07F 11/42
See application file for complete search history.

(56) References Cited

U.S. PATENT DOCUMENTS

| | | | | |
|---|---|---|---|---|
| 4,570,418 | A * | 2/1986 | Gino | B65B 61/06 53/244 |
| 10,843,359 | B2 * | 11/2020 | Ruhland | B26D 1/185 |
| 2002/0166427 | A1 * | 11/2002 | Wagner | B23D 25/02 83/37 |
| 2004/0259708 | A1 * | 12/2004 | Harding | B31D 5/0047 493/350 |
| 2013/0033090 | A1 * | 2/2013 | Jokonya | E21C 35/08 299/30 |
| 2014/0242098 | A1 * | 8/2014 | Yuan | A61J 1/00 424/184.1 |
| 2014/0363102 | A1 * | 12/2014 | Edwards | B65D 33/008 383/37 |
| 2015/0020660 | A1 * | 1/2015 | Jeng | B23D 59/001 83/74 |
| 2016/0067874 | A1 * | 3/2016 | Maruyama | B26D 1/245 347/104 |
| 2017/0028579 | A1 * | 2/2017 | Drebes | B26D 7/0625 |
| 2018/0141228 | A1 * | 5/2018 | Lin | B26D 5/02 |
| 2018/0304486 | A1 * | 10/2018 | Nakatsu | B65H 20/02 |
| 2019/0061191 | A1 * | 2/2019 | Sanz Ananos | B41J 11/66 |
| 2019/0070071 | A1 * | 3/2019 | Webster | B65D 75/30 |

FOREIGN PATENT DOCUMENTS

| | | | |
|---|---|---|---|
| EP | 1724075 | A3 | 12/2011 |
| WO | 2010073269 | A1 | 7/2010 |

* cited by examiner

DEVICE FOR SEPARATING MEDICATION PACKAGES AND A MEDICATION DISPENSER

PRIORITY

This is a non provisional patent application claiming priority of European patent application No. 16179224.7 filed on Jul. 13, 2016, the content of which is incorporated herein by reference.

TECHNICAL FIELD OF THE INVENTION

The present invention relates to a device for separating medication packages from a strip of medication packages according to the preamble of the appended independent claim. The invention also relates to a medication dispenser incorporating such a device.

BACKGROUND OF THE INVENTION

Medications can be dispensed to a patient using an automatic medication dispenser. For this purpose, the medications to be dispensed are typically placed in a plurality of interconnected medication packages. The medication packages are arranged sequentially in a chronological order according to the taking time of the medications in each medication package. When it is time to take certain medications, the corresponding medication package is separated from the medication strip and delivered to the patient.

Various devices for separating medication packages from a medication strip are known in the prior art. One known example of such a device comprises a cutting base and a circular cutting blade that is arranged against the cutting base. A medication package is separated from the medication strip by moving the circular cutting blade transversely over the medication strip from one longitudinal edge of the strip to the other.

A problem associated with the known device for separating medication packages from a medication strip is that during the cutting operation the medication strip can easily wrinkle between the circular cutting blade and the cutting base. As a result of this the medication strip may not be properly cut, or the device may even get broken if the medication strip jams between the circular cutting blade and the cutting base.

OBJECTIVES OF THE INVENTION

It is the main objective of the present invention to reduce or even eliminate the prior art problems presented above.

It is an objective of the present invention to provide a device for separating medication packages from a strip of medication packages. In more detail, it is an objective of the invention to provide a device enabling to cut a strip of medication packages so that the wrinkling of the strip during the cutting process can be avoided. It is a further objective of the invention to provide a device enabling to separate medication packages from a strip of medication packages in an accurate and reliable manner.

It is also an objective of the present invention to provide a device for separating medication packages having a long lifetime and freedom of service. It is a further objective of the invention to provide a device for separating medication packages having means of detecting a possible need for service well beforehand and thus avoiding cutting failures and breakage of the device.

It is also an objective of the present invention to provide a medication dispenser that is capable of delivering medication packages to a patient in an accurate and reliable manner.

In order to realise the above-mentioned objectives, the device according to the invention is characterised by what is presented in the appended independent claim. Advantageous embodiments of the invention are described in the dependent claims.

DESCRIPTION OF THE INVENTION

A typical device according to the invention for separating medication packages from a strip of medication packages comprises a cutting base along which the strip of medication packages is to be moved, a circular cutting blade arranged perpendicularly against the cutting base, and an actuator connected to the circular cutting blade and configured to move the circular cutting blade in opposite first and second directions. In a typical device according to the invention the actuator is connected to the circular cutting blade with a spring suspension allowing the circular cutting blade to move in opposite third and fourth directions perpendicular to the cutting base.

The device according to the invention can be used to separate medication packages from a strip of medication packages. The medication packages are separated by cutting the strip between two successive medication packages. The medication packages are typically separated from the strip of medication packages one package at a time, although in some cases the cutting may be performed in such a manner that two or more medication packages are left interconnected.

The strip of medication packages, i.e. the medication strip, contains the medications to be dispensed to a patient within a certain period of time. The medications are placed in a plurality of interconnected medication packages. The medication packages are arranged sequentially in a chronological order according to the taking time of the medications in each medication package.

In a device according to the invention, the medication strip is moved along the cutting base. The medication strip is moved along the surface of the cutting base in a direction that is perpendicular to the first and second directions, i.e. to the directions in which the circular cutting blade can be moved with the actuator. This means that the cutting direction of the circular cutting blade is essentially perpendicular to the longitudinal direction of the medication strip.

The medication strip is cut with the circular cutting blade that is arranged perpendicularly against the cutting base and moved by the actuator over the medication strip from one longitudinal edge to the other. That the circular cutting blade is arranged perpendicularly against the cutting base means that the plane of the circular cutting blade is perpendicular to the surface of the cutting base. The cutting base may comprise a groove in which the cutting edge of the circular cutting blade is arranged to be moved. The surface of the cutting base is preferably planar.

The actuator is connected to the circular cutting blade with the spring suspension that allows the circular cutting blade to move in the opposite third and fourth directions perpendicular to the surface of the cutting base. The third direction is the direction towards the cutting base, and the fourth direction is the direction away from the cutting base. The third and fourth directions are perpendicular to the directions in which the circular cutting blade can be moved with the actuator, i.e. to the first and second directions. The circular cutting blade is rotatably mounted to the spring suspension, whereby the circular cutting blade may rotate against the cutting base when the circular cutting blade is moved with the actuator.

The spring suspension is arranged to press the cutting edge of the circular cutting blade against the surface of the cutting base. When the circular cutting blade is moved with the actuator over the medication strip, the spring suspension ensures that the medication strip can be cut properly. Because of the spring suspension the circular cutting blade can climb on the medication strip, which has been found to improve the cutting result so that the wrinkling of the medication strip between the circular cutting blade and the cutting base during the cutting process can be avoided. The spring suspension also prevents the medication strip from jamming between the circular cutting blade and the cutting base, and thus prevents the device from being damaged.

The spring suspension may comprise a frame that is connected to the actuator, and a bearing on which the circular cutting blade is mounted. The bearing is connected to the frame in a movable manner so that the circular cutting blade can move with respect to the frame. The spring suspension may comprise one or more springs, such as coil springs, connected between the frame and the bearing. The spring suspension may preferably comprise two springs for suspending both ends of the bearing to the frame. The springs are arranged to press the circular cutting blade against the cutting base, while at the same time the springs allow the circular cutting blade to move away from the cutting base when the circular cutting blade is moved over the medication strip.

The device according to the invention can be used in an automatic medication dispenser that dispenses medications to a patient according to a scheduled medication regimen. The medications to be dispensed are placed in interconnected medication packages according to the taking time of the medications. The medication packages are stored inside the medication dispenser into a container from where the medication strip is conveyed to the device using a conveyor. When it is time to take certain medications, the corresponding medication package is separated from the medication strip with the device according to the invention and delivered to the patient.

An advantage of the device according to the invention is that it enables to cut a strip of medication packages so that the wrinkling of the strip during the cutting process can be avoided. Another advantage of the device according to the invention is that it enables to separate medication packages from a strip of medication packages in an accurate and reliable manner.

According to an embodiment of the invention the actuator comprises a conveyor belt to which the spring suspension is connected, and a DC motor configured to drive the conveyor belt. The conveyor belt is an endless belt that is preferably made of rubber. The spring suspension may be connected to the conveyor belt with a clip. The conveyor belt is arranged around reels of a reel assembly. Preferably, the reel assembly comprises two reels around and between which the conveyor belt is arranged to extend. The reels are preferably provided with a toothing on their periphery. The conveyor belt preferably comprises corresponding teeth moulded onto its inner surface for engagement with the toothed reels. The DC motor is connected to at least one of the reels to rotate the reel(s) and thereby to drive the conveyor belt. The conveyor belt can be moved in different directions by changing the direction of rotation of the DC motor. Thus the circular cutting blade can be moved in the first or the second direction depending on which direction the DC motor is rotated. The operation of the DC motor may be controlled with a control unit.

According to an embodiment of the invention the device comprises a camera for monitoring the circular cutting blade and the strip of medication packages. The camera is preferably positioned in such a manner that it can image the circular cutting blade and the medication strip simultaneously. The camera is preferably arranged to image from above the cutting base towards the cutting base in an imaging direction that is essentially perpendicular to the first and second directions, i.e. to the directions in which the circular cutting blade can be moved with the actuator. The operation of the camera may be controlled with a control unit. Using the camera the positions of the circular cutting blade and the medication strip can be monitored. The camera can also be used to monitor the shape of the medication strip as well as the positions of the cutting areas and perforations between the medication packages.

According to an embodiment of the invention the actuator is configured to control the position of the circular cutting blade based on the image data received from the camera. By analysing the image data received from the camera, the position of the medication strip and especially the position of the cutting area between the medication packages can be determined. Based on this information it can be ensured that the medication strip is at a correct position on the cutting base when the circular cutting blade is moved with the actuator over the medication strip in order to separate a medication package from the medication strip. The device may comprise a control unit that comprises a processor for analysing the image data to determine the position of a cutting area with respect to the circular cutting blade and a memory for storing the image data as well as the position data that is conveyed to the actuator.

According to an embodiment of the invention the device comprises a sensor for detecting the conveyance of the separated medication package away from the cutting base. The device may comprise conveying means for conveying the separated medication package from the cutting base towards an outlet of the device. The conveying means may comprise one, two or more than two conveyor rollers, one, two or more than two conveyor belts or combined conveyor rollers and belts. The device may comprise one, two, three or more than three sensors to detect the medication package. The sensor can be an optical, mechanical, magnetic or RF based sensor. If the medication package does not reach the sensor(s) when being conveyed in a certain time, the device detects a possible problem in cutting and uses the camera to take image(s) of the cutting base. The device can comprise an image processor to analyze the medication strip and the cutting result on the cutting base. The device may also be connected to a remote server where the image can be transmitted for analysis. The remote server may notify the service person(s) to analyze the image. The user interface of the remote server may contain means of taking images with the camera, transfer the medication strip or the medication package and/or command retrial of cutting. Based on these images, for example, the cutting blade becoming blunt and the need to service the device can be detected.

According to an embodiment of the invention the device comprises means for measuring an electrical signal indicative of a force applied to the circular cutting blade, and the actuator is configured to control the movement of the circular cutting blade based on the measured electrical signal. When the circular cutting blade is moved over the medication strip in order to cut it, the force that is applied to the circular cutting blade varies depending, for example, on the shape of the medication strip. The varying force produces measurable changes in one or more electrical signals in the actuator that moves the circular cutting blade. The electrical signal to be measured can be either current or voltage in the actuator. Based on the value of this electrical signal, for example, the speed of the circular cutting blade can be changed.

According to an embodiment of the invention the actuator is configured to stop the movement of the circular cutting blade when the measured electrical signal exceeds a predetermined threshold value. By stopping the circular cutting blade, the device can be prevented from getting broken.

According to an embodiment of the invention the electrical signal is the current consumed by the DC motor. The current of the DC motor can be used to determine the condition of the DC motor.

According to an embodiment of the invention the diameter of the circular cutting blade is at least 10 mm. An advantage of using a circular cutting blade whose diameter is at least 10 mm is that the medication strip cannot easily wrinkle between the circular cutting blade and the cutting base during the cutting process, and thus the cutting result is improved. The diameter of the circular cutting blade is preferably less than 80 mm, and more preferably 20-40 mm.

According to an embodiment of the invention the cutting base is made of one of the following materials: acrylic plastic, polyethene, brass or aluminium. The use of a soft material in the cutting base enables to accurately cut thin plastic material such as the material that is typically used in medication packages. The use of a soft material in the cutting base also prevents the circular cutting blade from becoming blunt. Although in the course of time, the cutting base that is made a soft material can wear and even a groove can be formed on the surface of the cutting base, the cutting result of the device does not decrease because the spring suspension ensures that circular cutting blade stays against the cutting base.

According to an embodiment of the invention the circular cutting blade is made of a metal or a ceramic material. The use of a hard material in the circular cutting blade improves the cutting result. The use of the hard material in the circular cutting blade also ensures that the cutting edge of the circular cutting blade does not easily become blunt.

According to an embodiment of the invention the circular cutting blade is configured to make an opening on the edge of the medication package. The opening allows a patient to easily open the medication package by tearing. The device may comprise conveying means which are configured to first convey the medication package to an opening position and then to a separation position. The length of the opening can be, for example, 3-15 mm or 6-10 mm. The distance between the opening and the separation position can be, for example, 5-15 mm or 6-10 mm.

According to an embodiment of the invention the device comprises a circular perforation blade arranged side by side with the circular cutting blade. The circular perforation blade is used to perforate the medication package at the same time as the circular cutting blade separates it from the medication strip. The perforation allows a patient to easily open the medication package by tearing. The circular perforation blade is preferably attached to the actuator with the same spring suspension as the circular cutting blade. The circular perforation blade may be mounted on the same bearing as the circular cutting blade. The circular perforation blade can alternatively be separately attached to the actuator with a separate spring suspension and mounted on a separate bearing. The diameter of the circular perforation blade is essentially the same as the diameter of the circular cutting blade.

According to an embodiment of the invention the distance between the circular perforation blade and the circular cutting blade is less than 20 mm. The distance between the circular perforation blade and the circular cutting blade is preferably at least 3 mm so that the medication package can be easily opened. If the perforation was closer than 3 mm from the edge of the medication package, it would be very difficult to open the medication package. The distance between the circular perforation blade and the circular cutting blade can be, for example, 5-15 mm or 6-10 mm.

According to an embodiment of the invention the circular perforation blade is made of a metal or a ceramic material. The use of a hard material in the circular perforation blade improves the perforation result. The use of the hard material in the circular perforation blade also ensures that the spikes of the circular perforation blade do not easily become blunt.

According to an embodiment of the invention the cutting base is arranged to receive a plurality of strips of medication packages arranged next to each other. The cutting base may be designed to receive, for example, two medication strips, which are moved along the surface of the cutting base in parallel and at a distance from each other. The circular cutting blade is preferably kept at a position between the medication strips from which position the circular cutting blade can be moved to cut either one of the medication strips by moving the circular cutting blade either to the first or the second direction using the actuator.

According to an embodiment of the invention the device comprises a sensor for detecting whether the circular cutting blade is located at a certain position. Preferably, the position is the home position of the circular cutting blade. The actuator, preferably the DC motor, may comprise measurement means for measuring the distance moved from the home position to the first or the second direction. The position can be stored in the control unit. Based on the stored position, the device knows if the direction of the home position is in the first or the second direction.

The present invention also concerns a medication dispenser for dispensing medications to a patient according to a scheduled medication regimen. A typical medication dispenser according to the invention comprises a device for separating medication packages from a strip of medication packages. The device comprises a cutting base along which the strip of medication packages is to be moved, a circular cutting blade arranged perpendicularly against the cutting base, and an actuator connected to the circular cutting blade and configured to move the circular cutting blade in opposite first and second directions. The actuator is connected to the circular cutting blade with a spring suspension that allows the circular cutting blade to move in opposite third and fourth directions perpendicular to the cutting base. The medication packages are stored inside the medication dispenser into a container from where the medication strip is conveyed to the device using a conveyor. When it is time to take certain medications, the corresponding medication package is separated from the medication strip with the device according to the invention and delivered to the patient.

The exemplary embodiments of the invention presented in this text are not interpreted to pose limitations to the applicability of the appended claims. The verb "to comprise" is used in this text as an open limitation that does not exclude the existence of also unrecited features. The features recited in the dependent claims are mutually freely combinable unless otherwise explicitly stated.

DETAILED DESCRIPTION OF THE DRAWINGS

Figure 1A:
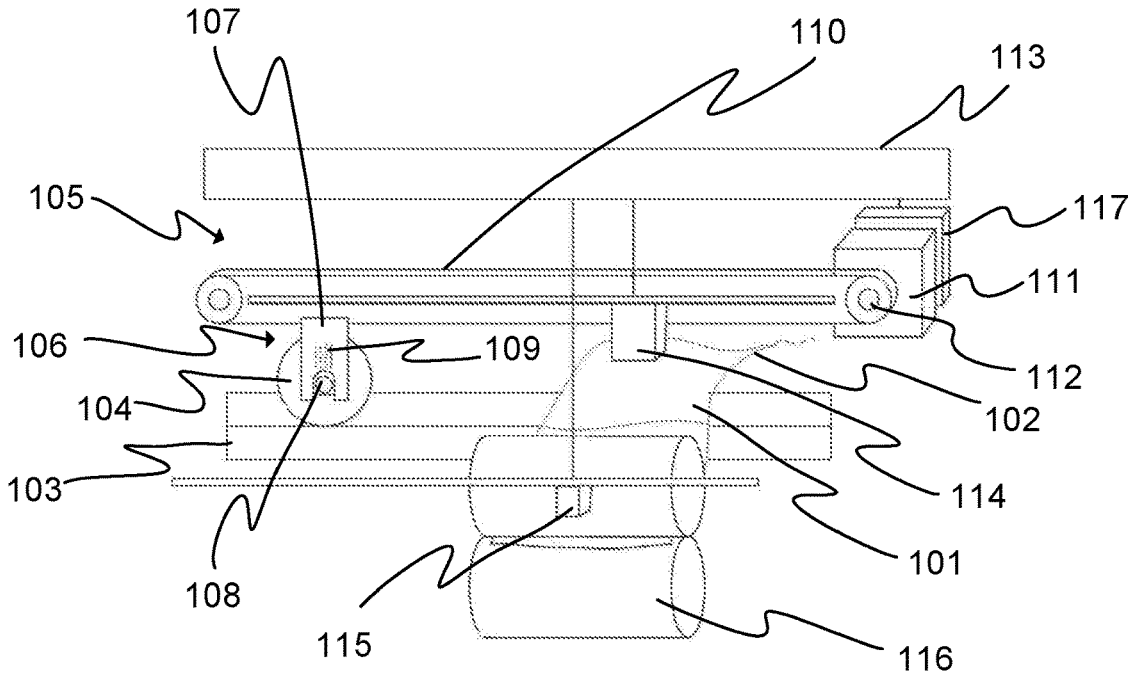
FIG. 1A illustrates a front view of a device according to a first embodiment of the invention.
Figure 1B:
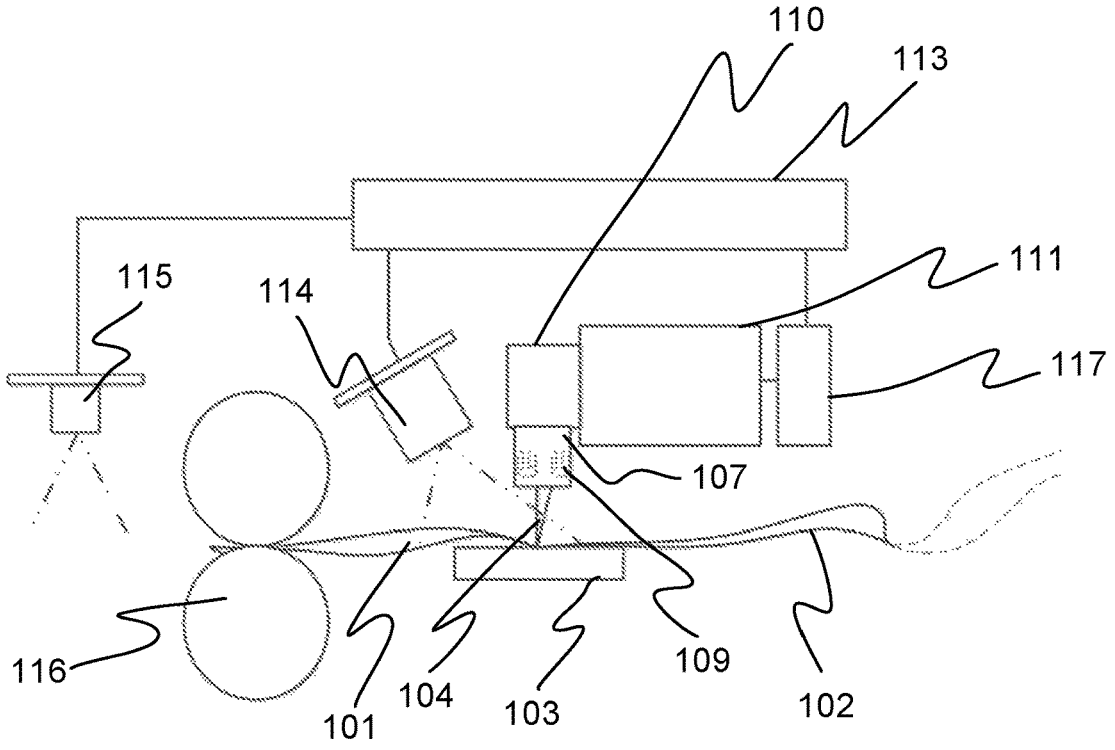
FIG. 1B illustrates a side view of the device according to FIG. 1A.

The invention is now described with reference to the figures. FIGS. 1A and 1B illustrate a front view and a side view of a device according to a first embodiment of the invention, respectively. The device is used for separating medication packages 101 from a medication strip 102.

The device comprises a cutting base 103 along which the medication strip 102 is moved and a circular cutting blade 104 for cutting the medication strip 102 between two successive medication packages 101. The circular cutting blade 104 is arranged perpendicularly against the cutting base 103. The device comprises an actuator 105 for moving the circular cutting blade 104 in opposite first and second directions, which are perpendicular to the moving direction of the medication strip 102.

The actuator 105 is connected to the circular cutting blade 104 with a spring suspension 106 that allows the circular cutting blade 104 to move in opposite third and fourth directions, which are perpendicular to the cutting base 103. The third and fourth directions are perpendicular to the directions in which the circular cutting blade 104 is moved, i.e. to the first and second directions. The spring suspension 106 presses the cutting edge of the circular cutting blade 104 against the surface of the cutting base 103. When the circular cutting blade 104 is moved with the actuator 105 over the medication strip 102, the spring suspension 106 ensures that the medication strip 102 can be cut properly.

The spring suspension 106 comprises a frame 107 and a bearing 108 on which the circular cutting blade 104 is mounted. The bearing 108 allows the circular cutting blade 104 to rotate against the cutting base 103 when the circular cutting blade 104 is moved with the actuator 105. The bearing 108 is connected to the frame 107 in a movable manner so that the circular cutting blade 104 can move with respect to the frame 107 in the third and fourth directions. The spring suspension 106 comprises two coil springs 109 each of which suspends one end of the bearing 108 to the frame 107. The coil springs 109 press the circular cutting blade 104 against the cutting base 103, while at the same time the coil springs 109 allow the circular cutting blade 104 to move away from the cutting base 103 when the circular cutting blade 104 is moved over the medication strip 102.

The actuator 105 comprises a conveyor belt 110 and a DC motor 111 for driving the conveyor belt 110. The conveyor belt 110 is arranged around two reels 112, and the DC motor 111 is connected to one of the reels 112 to rotate the reel 112 and thereby to drive the conveyor belt 110. The conveyor belt 110 can be moved in different directions by changing the direction of rotation of the DC motor 111. The frame 107 of the spring suspension 106 is connected to the conveyor belt 110. Thus the circular cutting blade 104 can be moved in the first or the second direction depending on which direction the DC motor 111 is rotated. The operation of the DC motor 111 is controlled with a control unit 113.

The device comprises a camera 114 for monitoring the circular cutting blade 104 and the medication strip 102. Using the camera 114 the positions of the circular cutting blade 104 and the medication strip 102 can be monitored. Based on this information it can be ensured that the medication strip 102 is at a correct position on the cutting base 103 when the circular cutting blade 104 is moved with the actuator 105 over the medication strip 102 in order to separate the medication package 101. The camera 114 is also used to monitor the shape of the medication strip 102 as well as the positions of the cutting areas and perforations between the medication packages 101. The camera 114 is also used to take images of the reason for the fault if the separated medication package 101 does not reach a sensor 115. The sensor 115 is used to detect the conveyance of the separated medication package 101 away from the cutting base 103. The separated medication package 101 is conveyed using two conveying rollers 116 between which the medication package 101 is conveyed. The operation of the camera 114, the sensor 115 and the conveying rollers 116 is controlled with the control unit 113.

The device comprises a current meter 117 for measuring the current consumed by the DC motor 111, which current is indicative of a force applied to the circular cutting blade 104. Using this current information, the actuator 105 controls the movement of the circular cutting blade 104, for example, by changing the speed of the circular cutting blade 104.

Figure 2A:
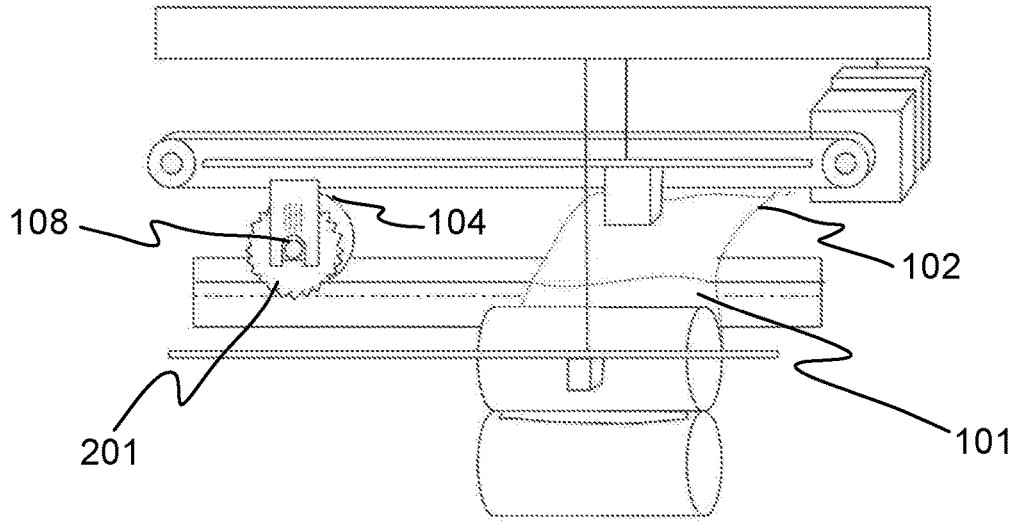
FIG. 2A illustrates a front view of a device according to a second embodiment of the invention.
Figure 2B:
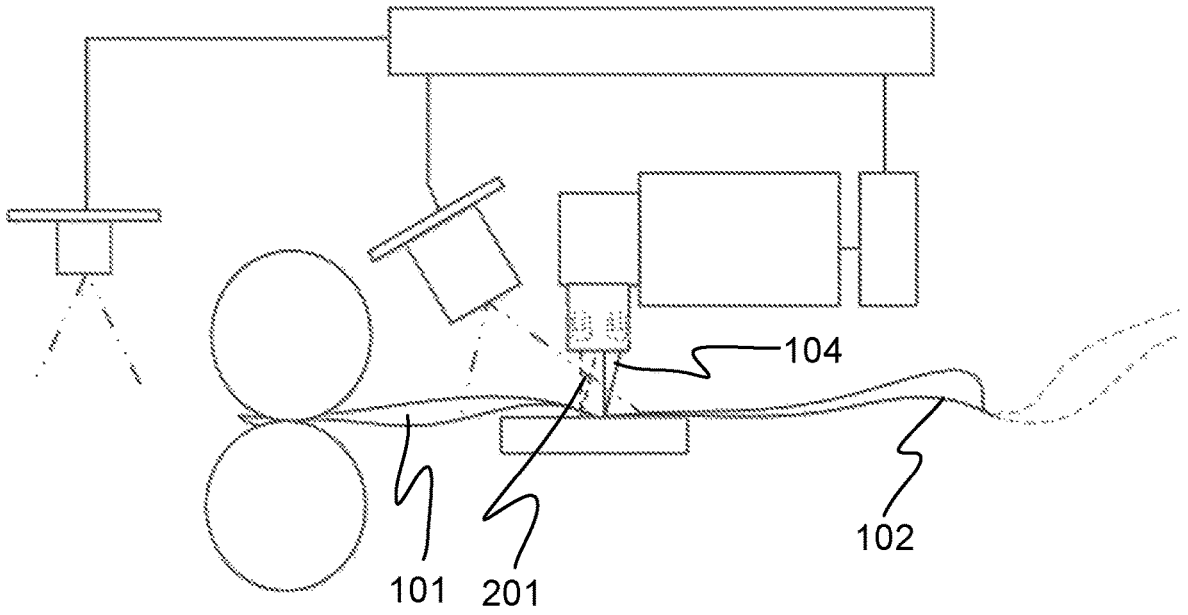
FIG. 2B illustrates a side view of the device according to FIG. 2A.

FIGS. 2A and 2B illustrate a front view and a side view of a device according to a second embodiment of the invention, respectively. The device differs from the device of FIGS. 1A and 1B in that it comprises a circular perforation blade 201 that is arranged side by side with the circular cutting blade 104. The circular perforation blade 201 is used to perforate the medication package 101 at the same time as the circular cutting blade 104 separates it from the medication strip 102. The perforation allows a patient to easily open the medication package 101 by tearing. The circular perforation blade 201 is mounted on the same bearing 108 as the circular cutting blade 104. The diameter of the circular perforation blade 201 is the same as the diameter of the circular cutting blade 104.

Only advantageous exemplary embodiments of the invention are described in the figures. It is clear to a person skilled in the art that the invention is not restricted only to the examples presented above, but the invention may vary within the limits of the claims presented hereafter. Some possible embodiments of the invention are described in the dependent claims, and they are not to be considered to restrict the scope of protection of the invention as such.

What is claimed is:

1. A device for separating medication packages from a strip of medication packages, comprising:

a cutting base, along which, the strip of medication packages is to be moved;

conveying means, selected from one or more conveyor rollers, one or more conveyor belts or combination of conveyor rollers and conveyor belts, to move the strip of medication packages along the cutting base, a circular cutting blade arranged perpendicularly against the cutting base; and an actuator connected to the circular cutting blade and configured to move the circular cutting blade in opposite first and second directions, wherein the actuator is connected to the circular cutting blade with a spring suspension allowing the circular cutting blade to move in opposite third and fourth directions perpendicular to the cutting base, wherein the device comprises means for measuring an electrical signal indicative of a force applied to the circular cutting blade and the actuator is configured to control a speed of the circular cutting blade based on the measured electrical signal, and wherein the circular cutting blade is configured to make two subsequent cuts: first an opening on an edge of the medication package and then to separate the package from the strip upon the conveying means moving the strip first to an opening position and then to a separation position.

2. The device according to claim 1, wherein the actuator comprises a conveyor belt to which the spring suspension is connected, and a DC motor configured to drive the conveyor belt.

3. The device according to claim 1, wherein the device comprises a camera for monitoring the circular cutting blade and the strip of medication packages.

4. The device according to claim 3, wherein the actuator is configured to control a position of the circular cutting blade based on image data received from the camera.

5. The device according to claim 1, wherein the device comprises a sensor for detecting conveyance of the medication package away from the cutting base.

6. The device according to claim 1, wherein the actuator is configured to stop movement of the circular cutting blade when the measured electrical signal exceeds a predetermined threshold value.

7. The device according to claim 1, wherein the electrical signal is current consumed by the DC motor.

8. The device according to claim 1, wherein the device comprises a circular perforation blade arranged side by side with the circular cutting blade.

9. The device according to claim 1, wherein the cutting base is arranged to receive a plurality of strips of medication packages arranged next to each other.

10. The device according to claim 1, wherein the device comprises a sensor for detecting whether the circular cutting blade is located at a certain position.

* * * * *